US005434334A

United States Patent [19]

Lomasney et al.

[11] Patent Number: 5,434,334

[45] Date of Patent: Jul. 18, 1995

[54] PROCESS FOR TREATING AN AQUEOUS WASTE SOLUTION

[75] Inventors: Henry L. Lomasney; Michael A. Lomasney; Richard A. Graves, all of New Orleans, La.

[73] Assignee: Monolith Technology Incorporated, New Orleans, La.

[21] Appl. No.: 982,654

[22] Filed: Nov. 27, 1992

[51] Int. Cl.[6] ..... G21F 9/00

[52] U.S. Cl. ..... 588/20; 588/7; 588/8; 588/255; 210/751; 976/DIG. 381; 976/DIG. 385

[58] Field of Search ..... 588/255, 6, 7, 8, 20; 210/751; 976/DIG. 381, DIG. 385

[56] References Cited

U.S. PATENT DOCUMENTS

| | | | |
|---|---|---|---|
| 4,010,108 | 3/1977 | Gablin et al. . | |
| 4,119,560 | 10/1978 | Sheeline | 588/20 |
| 4,123,380 | 10/1978 | Norell | 252/6 |
| 4,194,842 | 3/1980 | Puthawala | 366/76 |
| 4,230,597 | 10/1980 | Bustard et al. | 252/6 |
| 4,242,220 | 12/1980 | Sato | 588/20 |
| 4,246,233 | 1/1981 | Sheeline | 422/159 |
| 4,315,831 | 2/1982 | Morin et al. | 588/6 |
| 4,350,620 | 9/1982 | Haulinger et al. | 588/6 |
| 4,361,505 | 11/1982 | Kikuchi et al. | 588/20 |
| 4,400,313 | 8/1983 | Roberson et al. | 588/6 |
| 4,409,137 | 10/1983 | Mergan et al. | 252/632 |
| 4,434,074 | 2/1984 | Fox et al. | 252/628 |
| 4,559,170 | 12/1985 | Gay et al. | 252/628 |

*Primary Examiner*—Ngoclan T. Mai
*Attorney, Agent, or Firm*—Foley & Lardner

[57] ABSTRACT

Processes and devices are disclosed for converting an aqueous waste solution, such as a radioactive waste stream, into a highly concentrated sludge having substantially little or no water. In turn, the sludge may be converted into a solid polymeric form suitable for storage. The processes utilize a carrier liquid which has a boiling point higher than that of water, and which facilitates the transfer of heat to the water to vaporize the water into steam. A subsequent separation of the dewatered solution yields the highly concentrated sludge.

26 Claims, 4 Drawing Sheets

PROCESS FOR TREATING AN AQUEOUS WASTE SOLUTION

FIELD OF THE INVENTION

This invention relates to a process for treating an aqueous waste solution. More particularly, this invention relates to a process for removing water from the aqueous waste solution and, advantageously, converting the waste into a solid form suitable for disposal.

BACKGROUND OF THE INVENTION

Two essential parameters are recognized when dealing with processing of toxic or radioactive waste materials for burial:

1. A high integrity wasteform which will not leach or decompose on exposure to burial site environment is vital.
2. Volume reduction of burial wastes is important, and is especially important with radioactive and toxic wastes. The cost of burial space in licensed radioactive and toxic waste sites is very high; consequently, designers must seek cost effective techniques to reduce volume of such liquid wastes. The most effective techniques for reducing the burial volume of the waste are often effective in cost containment programs.

In dealing with aqueous waste solutions, one major goal is to find a method for removing the water. When this is accomplished, it is possible to avoid the added costs associated with burying water. An equally important consideration in dealing with radioactive and toxic wastes, namely, environmental stewardship. This dictates that the designer devise a means for solidifying the waste in a long term stable waste package.

In prior art radioactive waste processing, the preferred means for processing liquid waste solutions called for use of an evaporator which could drive off water and consequently concentrate the liquid waste to a desired salt-to-water ratio, and then use of a binder typically of portland cement to solidify the residue. The high salt concentration of the waste, however, impedes efficient heat transfer to effect evaporation and can lead to mechanical operational difficulties.

Prior techniques have presented a number of operational difficulties; namely, the mechanical complications that are synonymous with the mechanically complex operation of an evaporator unit. A secondary difficulty was experienced in dealing with the "prior art" binder systems. There was a potential for chemical incompatibility between the concentrated radioactive waste "evaporator-bottoms" and the portland cement binder which was used to form the solidified wasteform.

One popular process used previously involved mixing the concentrated aqueous waste slurry with a crosslinkable hydrophilic polymer. An example of such solidification media is an urea formaldehyde or a polyvinyl ester polymer. This process was used widely to solidify aqueous radioactive waste having high salt content. Such polymers form solid plastic composites, even in presence of water. However, the polymer/water waste composites that results from the hydrophilic polymers have been found to experience inconsistent wasteform properties due to the potentially adverse interactions between the aqueous waste concentrate and the polymer binder, especially during the polymerization process. A second problem area which is encountered with such a process is that it yields a wasteform that incorporates water in the final wasteform.

An alternative to the hydrophilic polymer involves the use of a bitumen resin into which the liquid waste is introduced, The bitumen is processed hot, thereby providing a means to volatilize water from the waste, reducing or eliminating water from the wasteform. The difficulty with the bitumen binder system rests primarily in the fact that it is impractical to operate such a system without the corresponding use of an evaporator of some design. This evaporator is used to "pre-concentrate" the aqueous waste stream. Also, the bitumens (and similar thermoplastic wasteforms) are not optimum solidification materials, because of their performance deficiencies under burial site conditions. For example, they can react with certain nitrate salts. Radiation tolerance is not good, and fire resistance is less than ideal.

Accordingly, there is a need for a process which can decrease or substantially remove the weight percent of water from aqueous waste solutions such as aqueous radioactive waste solutions. There is also a need for a process for producing a storable form of the waste, once the water has been removed. Likewise, there also is a need for storable waste forms made from aqueous waste solutions.

SUMMARY OF THE INVENTION

Accordingly, it is an object of this invention to provide a process which can decrease or substantially remove the weight percent of water from aqueous waste solutions such as aqueous radioactive salt solutions.

It is another object of this invention to provide a process for producing a storable form of the waste, once the water has been removed.

It is yet another object of this invention to provide new storable waste forms made from aqueous waste solutions.

A foregoing object is basically achieved by a process for treating an aqueous waste solution. The process comprises a first step of mixing an aqueous waste solution with a carrier liquid, which comprises a plasticizer or a non-bituminous resinous binder having a boiling point higher than that of water, to yield a first product solution. The first product solution is heated to vaporize at least some of the water in the first product solution, thereby yielding a first vapor stream and a dewatered product solution. The dewatered product solution comprises less water by weight than the first product solution.

Optionally, the dewatered product solution is then subjected to a separation which yields a sludge solution, and a supernatant which comprises predominantly the first liquid.

Optionally, another object can be achieved by mixing the sludge solution with a resinous binder or curing agent, or both, to produce a solid resinous product suitable for storage.

Yet another object is achieved by providing such dewatered product solution, sludge and solid resinous product suitable for storage.

Additional objects and advantages of the invention will be set forth in part in the description that follows, and in part will be obvious from the description, or may be learned by practice of the invention. The objects and the advantages of this invention may be realized and obtained by means of the compositions of matter and processes particularly pointed out in the appended claims.

DESCRIPTION OF THE PREFERRED EMBODIMENTS

Figure 1:
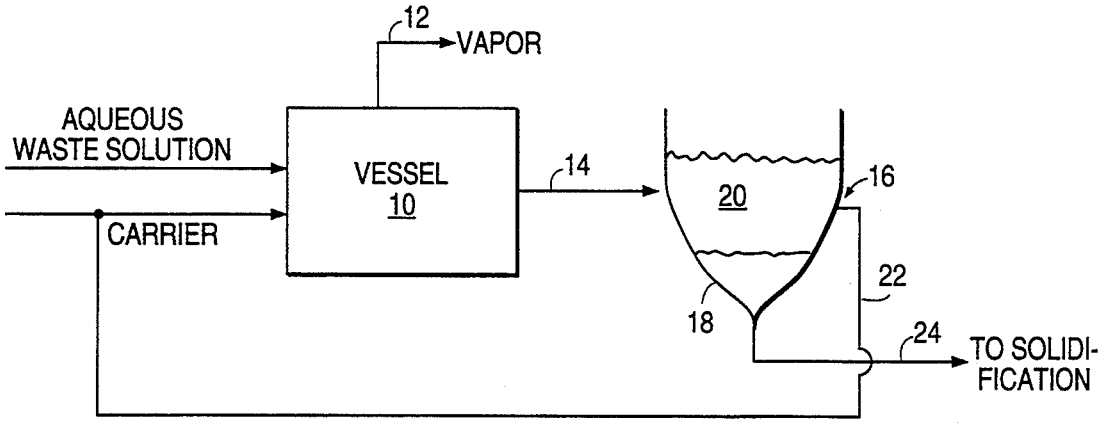
FIG. 1 is a schematic illustration of a process in accordance with this invention.

Using the processes described herein, it is possible to prepare a waste for burial which has little or substantially no water entrained in the wasteform; and as a consequence, a considerable improvement in cost effectiveness is realized. Further, using the process described herein, it is possible to achieve a high performance solidified waste binder system without the need for a conventional evaporator module, although one can be used in the processes of this invention. Further still, the carrier liquid has lubricating properties to facilitate the transport of salt residues through the vaporization process equipment without adverse scale formation, stress corrosion cracking, abrasion or scouring.

Depending on the quantity of the aqueous waste solution to be treated, a variety of process equipment can be used. The designs and equipment shown in FIGS. 1–5 are exemplary. For waste streams in range of 10–100 pounds per hour, the system shown in FIG. 2 is acceptable. For waste stream in range of 101–1000 pounds per hour, either of the systems shown in FIGS. 4A–4E or 5 would be acceptable.

In general, we have found that solid resinous product waste forms, which comprise very high loadings of radionuclide and/or heavy metal-contaminated sludge solution can be achieved with this process. Waste loadings of 40%, based on the total weight of the solid resinous product, routinely have been achieved. In some cases, we have achieved loadings of from about 50% to about 80% based on total weight of the solid resinous product. Advantageously, the loading of the sludge solution will be greater than about 20% by weight, more preferably greater than about 30%, more preferably greater than about 40%. In some instances, it may be desirable to have waste loadings greater than about 50%, more preferably greater than about 60%, more preferably greater than 70% and most preferably greater than about 80%.

In general, the preferred waste loading is determined by balancing the various processing parameters to achieve practical optimization of economics in terms of pounds of polymer per pound of waste. This optimization considers the viscosity of the slurry, its flow through the process equipment and the physical properties of the wasteform. In many cases, the waste loading is dictated by burial site specifications such as leach resistance (Toxic Characteristic Lead Procedure—TCLP), water swell properties, compression strength and/or radiation tolerance. Such parameters can be achieved through routine experimentation well within the skill of the art.

As stated above, the carrier can be either a plasticizer or a non-bituminous resinous binder. The carrier liquid must have certain properties. First, it must have a boiling point higher than that of water and be stable under high temperature. It must not deteriorate under the high steam conditions which generally will be imposed by the process. It should not foam or chemically react with the waste, although some minor foaming may be acceptable, and some chemical reaction might be tolerated depending upon the product(s) produced. The carrier must be able to tolerate a high waste loading without excessive viscosity increase. The carrier also should contribute to the integrity, including radiation and leaching resistance, of a solid resinous polymer waste form prepared in accordance with this invention.

The carrier can be a non-bituminous resinous binder of the thermoset (reactive) class. Such binders included, for example, epoxy-amines, free radical crosslinked polyesters, polyol-polyurethanes, and phenol-formaldehydes. When a resinous binder is used as the carrier, the curing agent(s), and additional binder if necessary, are added to the resulting product to yield the solid resinous polymer waste form. Such binders, for example, the epoxy-amines, are often likely to foam upon mechanical agitation. Thus, surfactants may be required to keep the foaming to a minimum during the process.

Where the carrier is non-reactive plasticizer, the binder and any necessary curing agents, converters, catalysts, etc. may be added at the end of the process cycle, thereby converting the waste from a salt/sludge-bearing liquid into a solid mass. Acceptable plasticizers include, for example, plasticizer class polymers such as aromatic hydrocarbon resin, aliphatic hydrocarbon resin, terpene resin, caster oil, triphenyl phosphate, glycerol acetates, fatty acid esters, epoxidized fatty acid esters, di-iso-tri-decyl phthalate, tri-metallic esters, alkylated phenol esterified tri-aryl phosphate, and linear C6–C11alcohol.

Yet other acceptable carriers in a accordance with this invention readily may be recognized by a skilled artisan upon reading this disclosure.

Embodiments of the process will be described below, with reference to the Figures.

Figure 2:
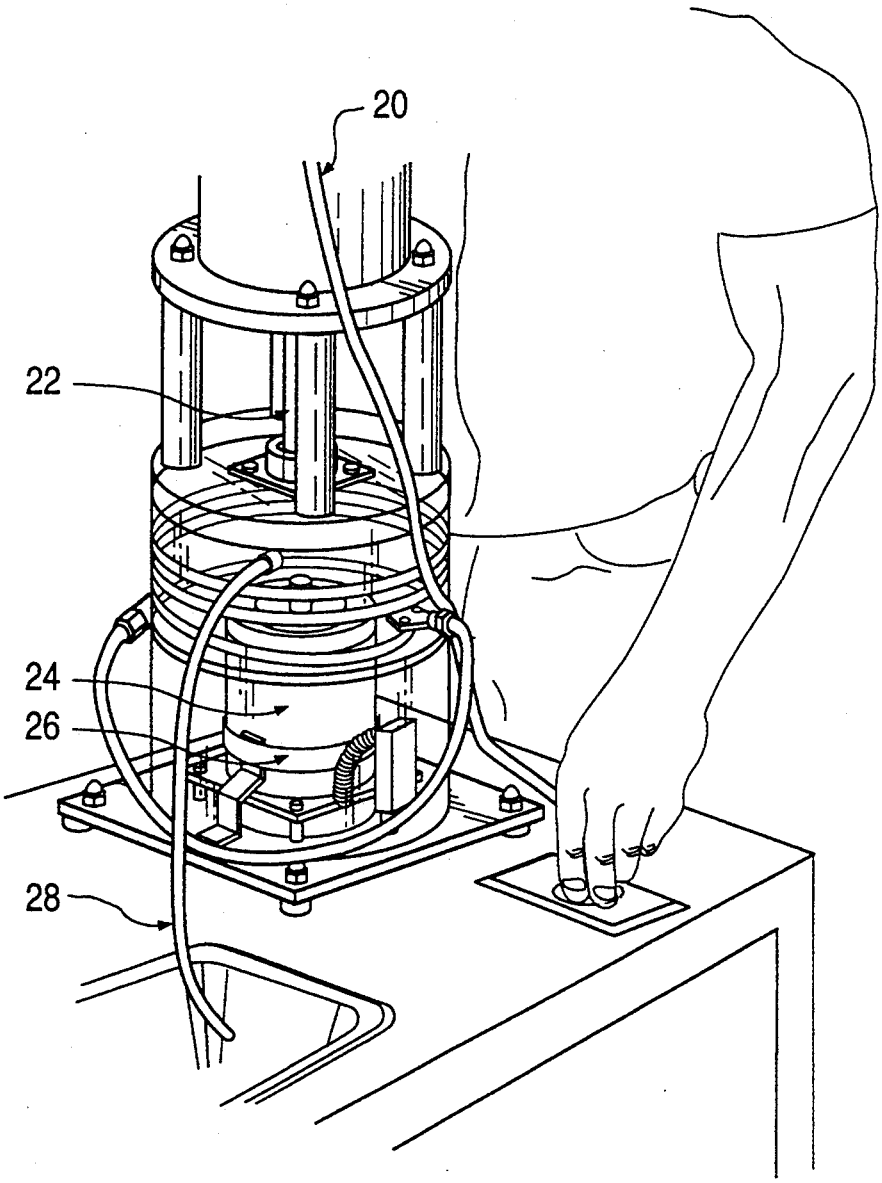
FIG. 2 is a photograph of an apparatus in accordance with this invention.

Referring now to FIG. 1, an aqueous waste solution and a carrier are mixed in vessel 10 to yield a first product solution. The vessel may be heated, as discussed below, to heat the first product solution in order to vaporize the water present. Vapor stream 12 is removed from vessel 10, and a dewatered solution is taken off through conduit 14 to vessel 16, where the dewatered solution is separated into sludge 18 and supernatant 20. The vapor stream may be mechanically treated to remove entrained liquid (not shown) and/or treated to remove entrain impurities in the vapor (not shown). The separation may be accomplished by simply allowing the dewatered solution to settle, advantageously in an inverted conically-shaped vessel, or by mechanical means such as centrifugation. The separation can be enhanced, for example, by maintaining the vessel 16 at elevated temperature. The supernatant 20, which comprises predominantly the carrier liquid, can be recycled through conduit 22 and added to the carrier liquid that is added to vessel 10. The sludge 18 can be taken off through conduit 24 and optionally treated further to form a polymeric resinous product.

An objective of this process is to vaporize the water associated with a aqueous waste solution. The operational goal is to efficiently achieve this vaporization at a reasonably high throughput, by using applied heat, either alone or in combination with other energy input. For example, heat for vaporization can be provided by a high shear mixing device, wave energy such as microwave energy, etc. Those skilled in the art will recognize several possible ways to provide the necessary energy for vaporization. Further, a mixing action is preferred in order to ensure the release of steam generated in the process. While conventional evaporators can be used, exemplary devices are provided below which avoid the complexity of conventional evaporator equipment. Optionally, an environment of reduced pressure can be included during the vaporization process, thereby enhancing vaporization of water into steam and depressing the operating temperature.

FIG. 2 illustrates an apparatus providing a high thermal flux delivered via the carrier, which accomplishes an efficient water vaporization while simplifying the transport of the contaminant species. In FIG. 2, mechanical agitation is accomplished with an electric motor 20 connected via shaft 22 to a dispersion blade located inside the process vessel 24. This device is designed to homogenize the hot carrier with the aqueous waste solution and to control the dynamics of the subsequently vaporized "off gases" while enhancing the intimate contact of the carrier which carries heat from the resistance heater 26. The heat which is delivered by the mixing shaft and the heat from the electrical resistance heater combine to vaporize the water in the aqueous waste solution which is introduced in slurry via conduit 28.

The vapor generated in the vaporization process likely will contain some entrained liquid as well as some entrained impurities from the aqueous waste solution. To remove the entrained liquid, conventional mechanical separators may be employed. Also, it is possible to "scrub" the vapor, for example, by introducing it into a vessel containing a scrubbing liquid which will remove entrained impurities (as illustrated in FIG. 4). Once the level of impurity in the scrubbing liquid is sufficiently high, the scrubbing liquid will lose its cleaning efficiency. If the scrubbing liquid is the same as the carrier liquid, or compatible therewith, it may be added to the carrier liquid or added to the mixing vessel containing the aqueous waste solution and carrier liquid.

Figure 3:
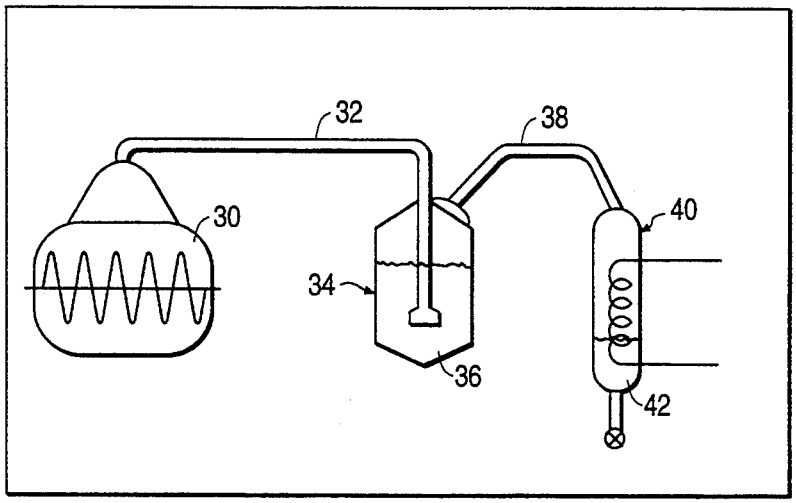
FIG. 3 comprises an schematic illustration of an apparatus in accordance with this invention.

Such optional treatment of vapor is illustrated in FIG. 3. Vaporization is carried out in vessel 30. The vapor exits via conduit 32 and is introduced into vessel 34 comprising scrubbing liquid 36. The impurities entrained in the vapor are removed by the scrubbing liquid and the cleansed vapor is taken off through conduit 38 and introduced into condenser 40 to yield condensate 42.

Optionally, it is possible to add metal complexant species to the product solution of the carrier and aqueous waste solution to enhance this scrubbing property. Examples of such complexants are chitosan, dialkylnapthylene sulfonic acid, amino phosphates, calixarenes, polycarboxylates, etc. The complexants may be added to the vessel containing the product solution, or to the carrier or to the aqueous waste solution.

Advantageously, the two process elements (vaporizer and scrubber) are designed such that, at the nominal throughput rate, a continuous homogenized state is maintained in the vaporizer so that vapor flow is smooth and continuous. Also, the vapor may be introduced into the scrubber vessel via a high dispersion mechanical agitation mechanism so that there is intimate contact between the steam and the scrubbing liquid.

Figure 4D:
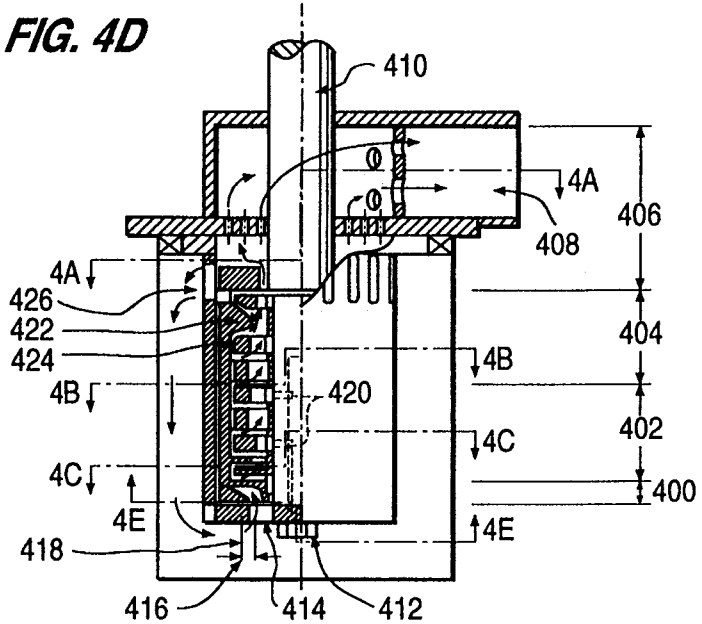
FIGS. 4A–4E illustrate an apparatus in accordance with this invention.
Figure 4E:
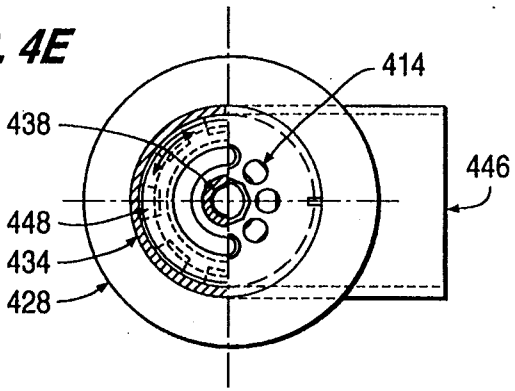
Figure 4A:
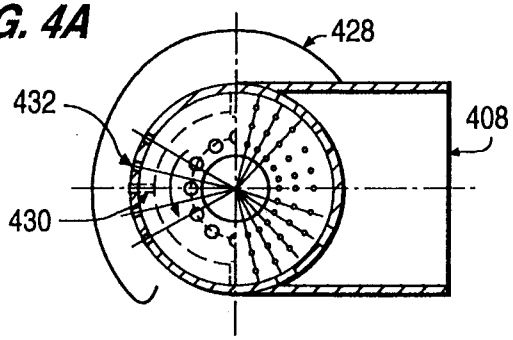
Figure 4B:
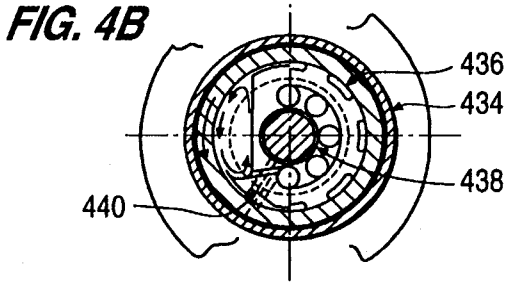
Figure 4C:
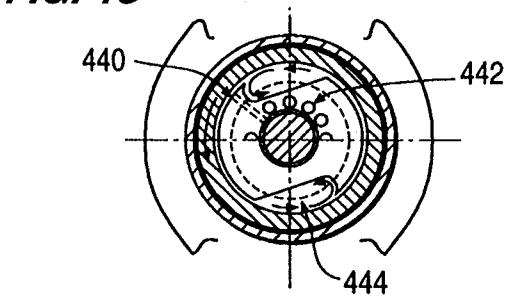

One possible mechanical device which can be used according to this invention is illustrated in FIGS. 4A–4E. In this device, the aqueous waste solution is added to hot carrier liquid which is rotated. FIG. 4A is a stepped cross-section along line 4A–4A of FIG. 4D. FIG. 4A shows four rotating outlets for resin and waste 430, resin waste outlets 432 steam outlet 408, and one gallon can 428. FIG. 4B is a stepped cross-section along line 4B—4B of FIG. 4D. FIG. 4B shows waste feed outlets 440, stationary cage 434, resin transfer holes 436, and stationary center support 438. FIG. 4C is a stepped cross-section along line 4C—4C of FIG. 4D. FIG. 4C shows shear line circulators 444 (one per stationary vaporizing disk), waste feed outlets 440, and steam vent holes 442. FIG. 4D shows circulating pump 400, heat and vapor generator 402, resin-vapor separator 404, vapor—resin droplet separator 406, steam outlet 408, drive and support shaft for outer cage 410, waste feed port 412, pump inlets 414, liquid head difference 416, average liquid level 418, rotating cage 422, cage resin level control dam 424 and outlet for resin 426. FIG. 4E is a stepped cross-section along line 4E—4E of FIG. 4D. FIG. 4E shows pump inlets 414, steam outlet 446, one gallon can 428, stationary outer cage 434, stationary center support 438, and rotating cage 448. Operational parameters are as follows:

1. It is necessary to maintain a stable region of carrier liquid rotation with a stable vortex surrounding the point of mechanical energy introduction (the rotor), which is also the point where the aqueous waste solution is injected.
2. The current load on the motor must be stable. Experience has shown that scale model rotator speed ranges of 5000 RPM to 8000 RPM will provide such stable motor loading. (It should be noted that in the case of device of FIG. 5, such high velocity would not be necessary because the baffling effect of the agitator elements provides an alternative means for controlling the process dynamics. Optionally, some of the heat generation can be achieved via an external source [i.e., hot oil or steam coursing through the mixer's internal area].)
3. FIGS. 4A–4E illustrates the essential elements of the vaporizer. The heat generation and vaporization zone achieves uniform vapor release due to the incorporation of labyrinthine passageways. (The device of FIG. 5 also utilizes such a design.)
4. Liquid shear maintains a zone of high pressure during the transfer of heat to the liquid. This pressure zone prevents premature cavitation in the high velocity zone of the rotor. The shear line velocity must be as high as manageable, considering excessive turbulence and working stresses on components. The resin vapor separator permits steam release with minimal in-can turbulence. The release of steam vapor must be smooth and continuous. This zone allows all entrained steam time to leave the circulating product solution before the carrier circulates back to the rotor to re-contact the aqueous waste solution.

Analysis of the operating vaporizer system focuses on the following operating zones of FIG. 4D, i.e., circulating pump 400, heat and vapor generator zone 402, the carrier/vapor separator 404, the vapor-resin droplet separator 406, and the vapor outlet 408. The shear line in this vaporizer maintains a high enough pressure gradient to prevent water vaporization at the shear line.

Under typical operating conditions, pressure is approximately 70 psia and temperature is approximately 300° F. Such conditions are achieved with a rotating outer case whose centrifugal force generates at least the minimum 70 psia. The vaporizer shown in FIGS. 4A–4E achieves this goal without need for a rotating shaft seal on the high pressure pump. Also, the resistance time in the high shear chamber is so short that separation of the heat transfer resin and the waste solids does not occur. In other words, the in-chamber turbulence and liquid circulation are intense so that separation does not occur. The circulating plows are positioned very close to the inside wall of the rotating chamber to force all materials in the chamber to circulate.

The function of the heat transfer resin inducer pump element to circulate the carrier liquid into the process container, and to supply it to the heat generation (vaporization) zone. Using the analogy of the operation of a basket centrifuge, one can see that a layer of water/-carrier in the rotating basket will have the same liquid thickness at both the top and the bottom of the basket. Also, using the inside diameter of the top basket ring to determine the liquid thickness, the larger the inside ring diameter, the thinner the liquid thickness and, conversely, the smaller the diameter, the thicker the liquid layer. Returning to the analogy of the basket centrifuge, one can see that once the rotating basket has been fully loaded, any more liquid added to the basket will cause an equal amount to be displaced up and over the top basket ring and out of the machine. Referring to the design of the vaporizer shown in FIGS. 4A–4E, one can see that the feed pump will introduce a regulated volume of liquid to the bottom of the rotating heat generator. Consequently, this heat transfer liquid will flow up through the vaporizer unit, over the larger inside diameter outlet ring and out of the vaporizer.

The heat generator (vaporizer) portion of the device of FIGS. 4A–4E consists of alternate rotating and stationary discs to create the high viscous shear areas. The aqueous waste solution feed is supplied under pressure and exits at the outer edge of the several stationary discs. This provides for the aqueous waste solution to arrive along with the carrier into the zone where the maximum heat is being generated. Since the pressure in this area is very high, the high pressure pump must provide enough pressure differential to cause a uniform and continuous flow of the aqueous waste solution into the high shear zone. This is achieved with a stationary deflector, or plow, which pulls hot liquid out of the area and forces it toward the center of the vaporizer.

The area in the center of the rotating heat generator flashes off steam as the hot water-resin is deflected out of the shear area into the lower pressure area where steam forms and is released from the system. The carrier liquid (along with any residual entrained water) is subsequently recirculated to the shear area for reheating. Advantageously, this process repeats as many times as needed until the carrier liquid-mixture becomes substantially anhydrous. (Such batch processing design will provide a mechanism whereby the input of aqueous waste solution is terminated when some predetermined waste loading is reached.)

An optional carrier liquid-vapor mist separator can be placed just above the heat generator. As a mixture of water vapor and carrier liquid is moved up from the heat generator, the centrifugal force generated by the rotating liquid will move the liquid to the outer walls and the lighter vapor will move toward the chamber center. This mechanical separator accomplishes two objectives: first, it allows time for the remaining heat to convert any water to steam, and second, centrifugal force will cause separation of the vapor from the carrier liquid. The carrier liquid residue is thrown out the top of the chamber into the drum for recirculating and the steam and off gases continues moving up the center of the vaporizer.

The vapor-carrier liquid droplet separator 406 can be a series of perforated (to permit the steam to move through) discs, alternately rotating and stationary. As the steam-ladened carrier liquid moves up through the discs, the carrier tends to separate from the steam. The carrier contacts the rotating discs. Once the resin is on a rotating disc, the centrifugal force moves it to the outer edge of the disc and then off the disc and back into the drum for recycling. This section is necessary to eliminate loss of carrier via carryover with steam vapor. It was previously observed that small droplets would otherwise carry out through the steam vent pipe with the steam. This section of the vaporizer functions like a water droplet eliminator in an air line.

Figure 5:
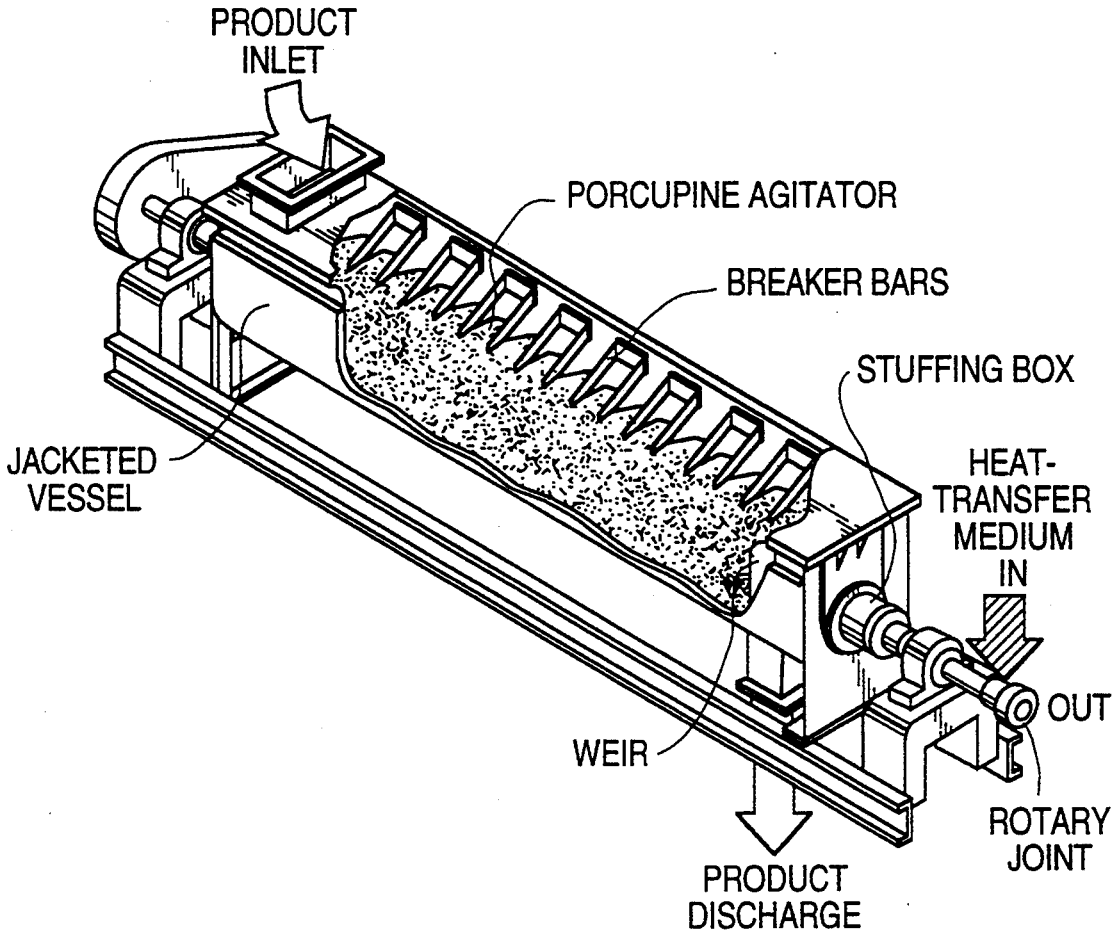
FIG. 5 illustrates an apparatus in accordance with this invention.

As a contrast to the device of FIGS. 4A–4E, the processing unit shown in FIG. 5 is presented as a means for illustrating the wide range of process machinery which can accomplish the objectives of the invention. The heat required for vaporizing the water is achieved by circulating steam or hot oil through the abundant internal surfaces of the process unit. The labyrinth pathway provided by the rotors and breaker bars controls the violence of steam flash. This minimizes oil carryover with the steam vapor. The rotation of the auger progressively advances the mixture of hot polymer and oil. As the polymer advances in the auger train, the steam vapor is progressively released and the water content that remains in the oil is progressively reduced.

In the Figures, the polymer progressively entrains the sludge residuals until a desired waste loading is achieved—then the pregnant carrier becomes an essential element in the solidification process by co-reacting with a crosslinker, or by functioning as a plasticizer in a system where a thermoplastic or thermoset network is subsequently added.

The following examples are intended to illustrate the invention and do not, in any way limit the claimed invention.

EXAMPLE 1

A low throughput process device was operated at laboratory scale utilizing a conventional high speed disperser blade for developing the high energy shear zone. This high speed disperser blade was a 3½" pitch diameter mounted by a ½" stainless steel shaft, connected to a 1 horsepower 3600 RPM electric motor. The process was operated in a one liter container which was surrounded with an electrical resistance heating blanket. The heat transfer polymer resin selected for this run was Nevex 100 modified hydrocarbon resin.

Externally supplied heat was used in this case. The heat was delivered via an electrical resistance heating blanket, the polymer mixture was raised to 300° F. and the motor, driving the high speed disperser blade, was switched on.

The viscosity of the carrier was such that a deep vortex formed around the disperser blade. A simulated aqueous radioactive waste solution was prepared, consisting of 23% of sodium chloride in water. This solution was introduced into the vortex region near the center of the disperser blade. The liquid was introduced at a rate of 10 ml per minute. At the end of one hour, approximately 600 ml of liquid waste had been processed.

The weight of "Nevex 100" resin was 200 grams. The salt content entrained in the copolymer was 138 grams. Twenty grams of ethylene vinyl acetate was added to the 338 grams of Nevex 100/salt composite.

This wasteform was observed to have compression strength of 1000 psi. and exceeded 38% entrained rad waste, by weight.

EXAMPLE 2

The same process as in Example 1 was used, except the carrier liquid was Neville NP-10, an aromatic plasticizer resin.

Using the external electrical resistance heating mantle, the plasticizing resin was heated to 300° F. and 1739 grams of 23% sodium chloride solution was added with high speed dispersion to evaporate water. In 7 hours, 1339 ml of water was evaporated under 21" Hg vacuum leaving 400 grams of salt entrained in the resin. Mixing was discontinued and the salt allowed to settle to the bottom of the 200 grams of plasticizer oil. One hundred grams was decanted. The residual salt and resin was solidified with a mixture of epoxy resin and Pacific Anchor 1730 amine cure.

| | | |
|---|---|---|
| Carrier Liquid | Neville NP-10 | 100 grams* |
| Sodium Chloride | (added 1739 grams of 23% solution) | 400 grams |
| Epoxy Binder | 240 molecular weight - 200 epoxide equivalent | 100 grams |
| Crosslinker | Ancamine 1730 | 25 grams |
| TOTAL | | 625 grams |

The salt content of the epoxy/salt composite was calculated to be 64%.

Compression strength of this wasteform exceeded 1000 psi.

EXAMPLE 3

The disperser of Example No. 1 was operated under vacuum with 250 grams epoxy resin and 400 grams of a lead contaminated sludge waste. (This sludge had heretofore been tested for leachable lead content and was found to leach lead at 10,000 ppm, when tested in accordance with the Toxic Characteristic Leaching Procedure (TCLP).

The vacuum level was approximately 22 inches of mercury. The polymer temperature was raised to 180° F. under 20 inches mercury vacuum to remove water. It is estimated that the entrained water in this wasteform was approximately 30%. When all entrained water had been removed via vaporization, the vacuum was released and the epoxy resin/lead contaminated sludge was removed from the mixing station and an 80 gram mixture (consisting of 20 grams sodium sulfide and 60 grams aromatic oil) was added to the epoxy resin. When this was uniformly mixed, the hardener, consisting of 42 grams of amine curing agent was added, and the mixture was allowed to cure. After overnight curing, the composite was observed to be rock hard. A subsequent test by an independent lab subjected this composite to leach resistance using the TCLP procedure. The test showed that the leachable lead was below the detection limit of the heat equipment, i.e., less than 0.05 ppm.

It will be apparent to those skilled in the art that various modifications and variations can be made to the compositions of matter and methods of this invention. Thus, it is intended that the present invention cover the modifications and variations of this invention provided they come within the scope of the appended claims and their equivalents. For example, those skilled in the art will recognize other carriers, binders and devices which may be used in accordance with the invention.

What is claimed is:

1. A process for treating an aqueous waste solution comprising the steps of:

A. mixing an aqueous waste solution with a carrier liquid, said carrier liquid comprising a plasticizer or a thermosetting, non-bituminous resinous binder which has a boiling point above the boiling point of water, to yield a first product solution;

B. heating said first product solution at a temperature above the boiling point of water to vaporize at least some of the water in said first product solution, thereby yielding a first vapor stream comprising predominantly steam, and a dewatered product solution, said dewatered product solution comprising less water by weight than said first product solution.

2. A process according to claim 1, comprising the additional step:

C. subjecting said dewatered product solution to a separation which yields a sludge solution and a supernatant, said supernatant predominantly comprising said carrier liquid.

3. The process of claim 2, wherein said carrier liquid is a plasticizer, and wherein, following Step C, said sludge solution is mixed with a resinous binder or curing agent, or both, to produce a solid resinous product.

4. The process of claim 3, wherein said resinous binder is selected from the group consisting of an epoxy-amine, a free radical crosslinked polyester, a polyol-polyurethane, or a phenol-formaldehyde.

5. The process of claim 3, wherein said plasticizer is selected from the group of a plasticizer class of polymers consisting of aromatic hydrocarbon resin, aliphatic hydrocarbon resin, terpene resin, caster oil, triphenyl phosphate, glycerol acetates, fatty acid esters, epoxidized fatty acid esters, di-iso-tri-decyl phthalate, tri-metallic esters, alkylated phenol esterified tri-aryl phosphate, and linear C6–C11 alcohol.

6. The process of claim 1, wherein said step of heating additionally comprises use of a reduced pressure environment.

7. The process of claim 1, wherein said step of heating is carried out in a heated vessel.

8. The process of claim 7, wherein said heated vessel is heated by a jacket surrounding the vessel or by heated passageways which are within the vessel, or both.

9. The process of claim 1, wherein said step of heating comprises use of a high shear mixing device which heats said first product solution a result of viscous shear.

10. The process of claim 1, wherein said dewatered product solution comprises less than about 5 percent weight percent water.

11. The process of claim 1, wherein said dewatered product solution comprises substantially no water.

12. The process of claim 1, wherein said first vapor stream is treated to separate an impurity which is entrained in said first vapor stream.

13. The process of claim 12, wherein said first vapor stream is contacted with a scrubbing liquid to remove said impurity.

14. The process of claim 13, wherein said scrubbing liquid is the same as said carrier liquid and, wherein at least a portion of said scrubbing liquid containing said impurity is added to said carrier liquid which is mixed in Step A.

15. The process of claim 12, wherein a complexant is incorporated into said carrier liquid, said aqueous waste solution, or said first product solution, said complexant being capable of complexing with said impurity.

16. The process of claim 15, wherein said complexant is selected from the group consisting of calixarenes, amino phosphates, chitosan, dialkylnapthylene sulfonic acid, polycarboxylates and alkali sulfides.

17. The process of claim 1, wherein said first vapor stream is subjected to mechanical separation which separates entrained liquid from said first vapor stream.

18. The process of claim 2, wherein Step C comprises allowing said dewatered product solution to settle in a vessel.

19. The process of claim 2, wherein Step C comprises mechanically separating said dewatered product solution to provide said sludge solution and said supernatant.

20. The process of claim 19, wherein Step C comprises centrifugation.

21. The process of claim 2, wherein at least a portion of said supernatant is added to said carrier liquid which is mixed in Step A.

22. The process according to claim 1, wherein said aqueous waste solution comprises radioactive waste.

23. A process for treating an aqueous waste solution comprising the steps of:

A. mixing an aqueous waste solution with a carrier liquid, said carrier liquid comprising a plasticizer or a non-bituminous resinous binder which has a boiling point above the boiling point of water, to yield a first product solution;

B. heating said first product solution to vaporize at least some of the water in said first product solution, thereby yielding a first vapor stream and a dewatered product solution, said dewatered product solution comprising less water by weight than said first product solution; and C. subjecting said dewatered product solution to a separation which yields a sludge solution and a supernatant, said supernatant predominantly comprising said carrier liquid.

24. The process of claim 23, wherein said resinous binder is thermoplastic.

25. The process of claim 24, wherein said resinous binder is selected from the group consisting of ethylene vinyl acetate, styrene butadiene, ethylene butylene polystyrene, polybutadiene, polyisoprene, butyl rubber, polyacrylate, vinyl isobutyl ether, atactic polypropylene, and polyethylene.

26. The process of claim 24, wherein said resinous binder has crosslinking sites and subsequently participates in the formation of the thermoset plastic matrix.

* * * * *